United States Patent [19]

Zimmerman

[11] 4,366,591

[45] Jan. 4, 1983

[54] AUTOMATIC SAFETY GANGPLANK

[76] Inventor: Mahlon N. Zimmerman, R.D. #2, Ephrata, Pa. 17522

[21] Appl. No.: 205,932

[22] Filed: Nov. 12, 1980

[51] Int. Cl.[3] ..... E01D 1/00

[52] U.S. Cl. ..... 14/71.3; 182/67

[58] Field of Search ..... 14/69.5, 71.1, 71.3; 182/65, 66, 67

[56] References Cited

U.S. PATENT DOCUMENTS

| | | | |
|---|---|---|---|
| 1,761,726 | 6/1930 | Havens | 182/65 X |
| 2,951,549 | 9/1960 | Holan | 182/66 |
| 3,404,417 | 10/1968 | Wollard | 14/71.5 |
| 3,538,528 | 11/1970 | Porter | 14/71.5 |
| 3,572,467 | 3/1971 | Hall | 182/67 |
| 3,710,893 | 1/1973 | Hippach | 182/67 X |
| 3,875,603 | 4/1975 | Mampaey | 14/69.5 |
| 4,011,615 | 3/1977 | Maxson | 14/71.1 |
| 4,094,381 | 6/1978 | Wilkerson | 182/67 |
| 4,157,742 | 6/1979 | Aanensen | 14/71.1 X |

FOREIGN PATENT DOCUMENTS

| | | | |
|---|---|---|---|
| 608699 | 5/1978 | U.S.S.R. | 14/69.5 |

OTHER PUBLICATIONS

Eight page brochure entitled, "Mack Aerial-Scope".

Four-page brochure entitled, "The Star of the Eighties is Here'from LT".

Four page brochure entitled, "The Stutphen Aerial Tower".

*Primary Examiner*—Nile C. Byers, Jr.

*Attorney, Agent, or Firm*—Weiser, Stapler & Spivak

[57] ABSTRACT

The automatic safety gangplank includes a plurality of cooperating ladder sections which are extendable from a fully telescoped or retracted position to an elongated position for extension from a dock to the deck of a ship. The end of the base ladder section is connected to a rotatable turntable and is equipped with a pair of lift cylinders. The turntable and the lift cylinders are connected to respectively rotate and elevate the base segment at all times, when the other gangplank ladder sections are either in their extended or retracted positions. A gangway extends from the end of the outermost ladder section in angular relationship and is positioned upon the deck of the ship. Automatic controls which are responsive to changes in elevation of the deck relative to the dock are provided to automatically either extend, retract, elevate or lower the safety gangplank as may be necessary to continuously maintain a safe walkway between the dock and the deck of the ship for all relative positions of the deck when the ship is either simply docked or when it is being loaded or unloaded.

36 Claims, 17 Drawing Figures

AUTOMATIC SAFETY GANGPLANK

BACKGROUND OF THE INVENTION

The present invention relates generally to gangplanks for ships, and more particularly, is directed to an automatic, hydraulically controlled, extendable, safety gangplank which extends from the dock to the deck of a ship.

It is the usual practice for ocean going vessels to tie up to a dock when in port by securing numerous lines between the ship and the dock in well known manner. A gangplank is then extended between the surface of the dock and the deck of the ship to allow crew, passengers and workmen to travel back and forth between the ship and the dock with relative ease and safety.

Most prior art gangplanks were fairly elementary in design and structure and comprised essentially a sturdy walk-way of suitable length to extend between the dock and the deck of the ship. Usually, either permanent or semi-permanent type of handrails were affixed to the gangplank and extended upwardly sufficiently to provide lateral safety as personnel traversed the gangplank. The prior art gangplanks are generally hoisted into position by utilizing the ship board cranes for this duty and the ends of the gangplank were then secured both to the dock and to the ship in known manner to provide basic safety for the personnel using the gangplank.

In normal situations, the prior art gangplanks generally were suitable for the use and were designed to automatically adjust to natural conditions, such as the rise and fall of the tides, by assuming more or less angularity relative to the deck of the ship in response to the environmental changes. For most types of cargo ships and passenger ships, the gangplanks presently in use have proved to be generally satisfactory and have operated without problems for many years.

However, in the case of many types of vessels which vary greatly in weight between their loaded and unloaded conditions, for example, large tank type vessels, that is the giant supertankers that are currently being used in increased numbers, the prior art fixed length type of gangplank which is currently in use has proved to be highly deficient in providing a safe passage between deck and dock due to the very service of the vessel in question.

Specifically, the large tankers are designed to hold literally millions of gallons of liquid products and these vessels are designed for loading and unloading the liquid cargo in relatively short periods of time, for example twenty-four hours. Accordingly, in the case of unloading, a tanker can reach port and tie up to dock in heavily loaded condition wherein the deck of the ship is elevated only a relatively short distance above the fixed surface of the dock. Similarly, great changes in weight can occur when conventional freighters are loaded or unloaded. Under such conditions, when the gangplank is extended between the dock and the deck of a loaded ship, the angle between the gangplank walkway and the deck of the ship is relatively gentle and the ship's crew, visitors and other personnel experience no problem when traversing between the ship and the dock and the dock and the ship. However, while and after the vessel is unloaded, the ship will float higher in the water and the height between the surface of the deck and the dock will be drammatically increased. That is, in many such vessels, an increase in deck elevation as the vessel is unloaded of between twenty-five and thirty feet over a twenty-four hour period is commonplace.

Because of the increase of deck height relative to the fixed dock elevation, a gangplank that had originally been set at a gentle angle will then be steeply inclined in order to reach between the dock surface which is fixed and the elevated surface of the ship after the ship had been unloaded. Under such conditions, a prior art gangplank becomes quite different to traverse, especially when members of the crew and other users are loaded with packages, luggage, supplies, etc. This same relative change in elevation between the deck of the ship and the surface of the dock would also be present at the other end of the run, that is when an unloaded ship entered port to take on a load of petroleum or other liquid or dry products. In such an instance, the procedure would be exactly reversed, that is, initially the empty ship's deck would be elevated far above the surface of the dock. A gangplank would have to be set at a sharp angle in order to span between the deck and the dock. After loading, the deck surface would then drop relative to the surface of the water due to the weight of the cargo to thus become closer to the surface of the dock. Consequently, the steep gangplank angle could then be reduced.

Additionally, the natural rise and fall of the tides in the vicinity of the dock might also serve to augment the problems encountered to thus cause an even increased elevation of the deck above the surface of the dock at those times when the incidence of high tide was simultaneous with a completely evacuated hold. The present invention seeks to overcome the difficulties stemming from the great changes in deck elevation by providing an extendable safety gangplank which functions to provide an elongated, adjustable walkway which can be automatically extended, retracted, elevated or depressed in response to the increase or decrease in relative elevation of the deck of the ship above the surface of the dock.

SUMMARY OF THE INVENTION

The present invention relates generally to the field of gangplanks for ships, and more particularly, is directed to an automatically or manually controlled extendable and elevating gangplank which is designed to provide a safe passageway between the deck of a ship and the surface of a dock.

In accordance with the teachings of the present invention, there is provided a base which is securely affixed to the dock adjacent to the position normally occupied by a ship, when either loading or unloading a liquid or dry cargo. The base comprises a stationary platform portion and a turntable portion which is rotatable relative to the stationary platform portion. The platform supports a hydraulic power system for operation of the safety gangplank and has secured thereto the fixed end of the base segment of a three segment, telescoping ladder or extendable gangplank construction. A pair of lift cylinders are interconnected between the turntable and a medium portion of the base segment in known manner to elevate or lower the base segment (and the telescoping segments) relative to the platform in response to either manual or automatic controls in the manner hereinafter more fully set forth.

The ladder preferably comprises three telescoping ladder segments, namely, the base segment, the middle or central segment and the end or fly segment. The end segment and the middle segment are telescopingly movable relative to the base segment in response either to remote or proximate manual controls or automatic controls to thereby extend the gangplank from a minimum length of approximately thirty-six feet to maximum length of approximately ninety feet.

A pivotal, rigid walkway means interconnects the remote end of the end ladder segment with the deck of the ship to provide easy access for personnel, crew, visitors and the like between the gangplank and the deck of the ship. Automatic controls, responsive to the angularity of the walkway relative to the gangplank, both vertically and horizontally, are wired into the hydraulic system of the automatic gangplank to provide automatic gangplank length and elevation adjustment as the level of the deck of the ship varies relative to the surface of the dock.

Manual controls are provided for operator control of the automatic safety gangplank both at the base platform and at the free end of the end segment whereby the length of the gangplank and the elevation of the gangplank can be manually controlled at either the fixed end of the gangplank or at the far or remote end of the end segment. Upon a ship reaching port, an operator can elevate and extend the automatic safety gangplank from the base platform as required to position the remote end of the fly segment adjacent to the deck of the ship near a usual exit therefrom, such as at a gate in the deck railing. The walkway is then maneuvered as necessary about its connection to the end of the gangplank to place the free end of the walkway solidly on the deck of the ship. The manual controls, both at the dock side on the stationary platform and at the remote end of the end gangplank segment can then be deactivated to prevent accidents due to inadvertent manual operation of the gangplank by untrained crew members, bystanders or other unauthorized personnel.

A first gangplank movement control means is provided and made responsive to the angularity of the walkway as it may be affected by the rise and fall of the level of the deck of the ship relative to the stationary dock surface. For example, assuming a tanker had tied up to the dock to unload crude oil in the usual, well known manner, after the unloading hoses had been properly connected to the outlet ports from the ship's tanks and after the safety gangplank of the present invention had been properly interconnected between the dock and deck, the action of the pumps will cause the fluid contents from the tanks to exit to the port side facilities and thereby considerably lighten the ship as the liquid cargo is dispensed. The removal of the cargo causes the ship to rise in the water and thereby increase the distance between the deck of the ship and the fixed pier surface. Under such conditions, the ship side of the pivotally connected walkway will begin to elevate and thereby pivot the walkway transversely about the remote end of the end gangplank segment.

Once the set limit of the elevation controller or elevation limit switch has been exceeded, the hydraulic power system will be activated to elevate automatically the base gangplank segment and the affixed middle and the end gangplank segments. The elevation of the gangplank reduces the angularity of the walkway relative to the deck and thus maintains the walkway in substantially the same angular relationship to the deck of the ship at all times despite the increased elevation of the deck of the ship as the cargo is unloaded. It should be noted that as the deck elevation increases and the gangplank is automatically elevated, there is a tendency to angularly cock the walkway between the deck of the ship and the remote end of the gangplank due to the increase in distance. This angular cocking activates a length limit switch or second gangplank movement control means which functions the hydraulic power system to cause the middle and end segments of the gangplank to further extend automatically, thereby maintaining the substantially transverse alignment of the walkway relative to the longitudinal axis of the gangplank. Thus, under automatic control, the angularity of the walkway activates limit switches to both elevate and elongate the gangplank to maintain a safe passageway between the deck of the ship and the dock under all elevated conditions of the deck of the ship relative to the pier.

It is therefore an object of the present invention to provide a novel automatic safety gangplank of the type set forth.

It is another object of the present invention to provide an improved automatic safety gangplank comprising elevatable and rotatable segment means extending between a fixed dock and the deck of a ship and automatic controls to automatically extend and elevate the segment means as the level of the deck of the ship rises relative to the level of the pier.

It is another object of the present invention to provide a novel automatic safety gangplank of the type comprising a three segment telescoping gangplank having one end of the base segment pivotally connected to a turntable, means to elevate and extend the other segments to reach to the level of the deck of a ship, and automatic means to adjust the elevation and overall length of the three gangplank segments in response automatically to changes in the height of the deck of the ship relative to the pier.

It is another object of the present invention to provide a novel automatic safety gangplank including rotatable, elevatable and extendable gangplank segment means extending from a fixed dock platform, walkway means spanning between the deck of a ship and the remote end of the gangplank segment means, manual control means to manually adjust the length and height of the extendable gangplank segment means and automatic means responsive to the angularity of the walkway means relative to the gangplank segment means to automatically adjust the height and length of the extendable gangplank segment means in response to changes in the elevation of the deck of the ship above the surface of the dock.

It is another object of the present invention to provide a novel automatic safety gangplank that is sturdy in construction, automatic in operation and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
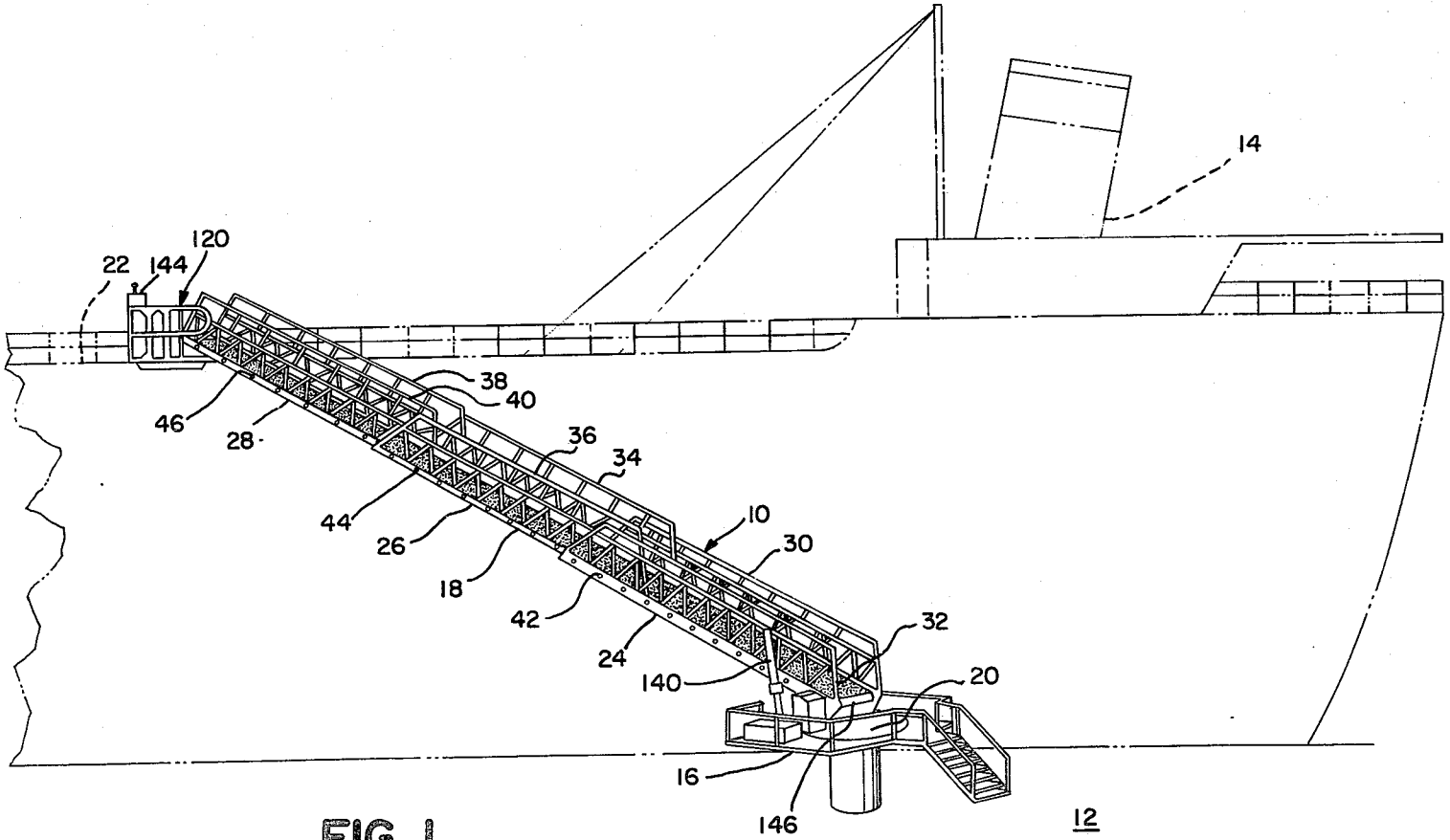
FIG. 1 is a side perspective view of the automatic safety gangplank of the present invention extending from a pier to the deck of a ship.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 an automatic safety gangplank generally designated 10 installed upon a pier or dock 12 of the type suitable to service large, ocean going vessels, for example, a tanker 14. A sturdy structural steel platform or walkway 16 is stationarily affixed to the pier in known manner to support and carry the extending gangplank portion 16 in all of its extended and elevated positions. A turntable 20 of known construction is mounted upon the platform 16 to rotate the extending gangplank portion 18 about a vertical axis in response to power supplied, for example, by a hydraulic power system 54 as necessary to adjust the lateral position of the extending gangplank portion 18 to reach the vicinity of the deck 22 of the vessel 14. Turntable controls 148 can be suitably mounted upon the platform 16 in known manner.

Figures 2, 3, 4:
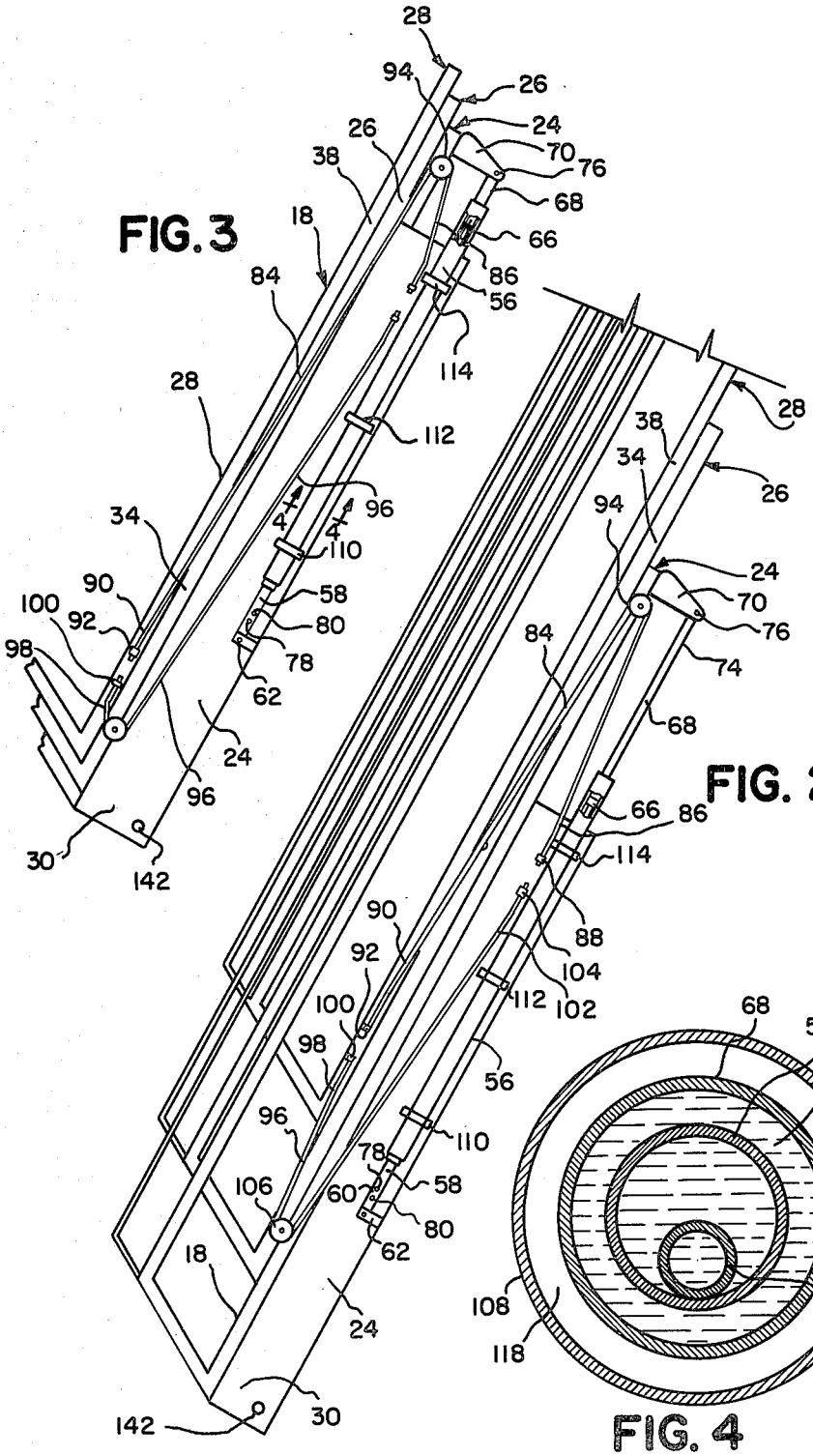
FIG. 2 is an enlarged, partial, schematic, side elevation view showing the telescoping segments of the gangplank in extended relationship.
FIG. 3 is a partial, schematic, side elevational view similar to FIG. 2 showing the gangplank segments in retracted relationship.
FIG. 4 is an enlarged, cross sectional view taken along line 4—4 on FIG. 3, looking in the direction of the arrows.

As shown in FIGS. 2 and 3 the extending gangplank portion 18 comprises a base segment 24 which extends from the turntable 20 and is rotated about a vertical axis thereby. A bottom pivotal connection 142 facilitates pivotal movement of the gangplank portion 18 relative to the turntable 20 and the platform 16. A middle gangplank segment 26 and an end or fly segment 28 are supported from the base segment 24 and are carried in telescoping arrangement therewithin. Each of the segments 22, 26, 28 is similarly fabricated with respective spaced pairs of side rails 30, 32, 34, 36, 38 and 40 which each carry as plurality of strengthening rungs 42, 44 and 46 therebetween. An expanded steel or aluminum mesh or other suitable strong footway 48, 50, 52 spans between the respective pairs of side rails 30, 32, 34, 36, 38 and 40 over the rungs 42, 44, 46, which plurality of rungs serve to reinforce and to support the footways 48, 50 and 52. It is noteworthy that the middle segment footway 50 and the fly segment footway 52 are supported in telescoping arrangement with the base segment footway 48 to provide a continuous footway when the safety gangplank is either elongated or shortened in response to either automatic or manual controls, as hereinafter more fully set forth.

Referring now to FIGS. 2–4, the gangplank extension system is illustrated showing a pair of left and right hydraulic cylinder means 56, 56′ mechanically interconnected between the gangplank base segment 24 and the middle segment 26 for selective extension and retraction of the middle segment 26 and fly segment 28 relative to the base segment 24. In the embodiment illustrated, each hydraulic cylinder means 56, 56′ comprises an affixed hydraulic cylinder rod 58 which has its fixed end 60 secured to a portion of the base segment 24 through a stationary bracket 62. The hydraulic cylinder rod 58 terminates at its remote end 64 in a suitable stationary piston 66 and is longitudinally movable relative thereto in response to operation of the automatic controls 138 or manual controls 144, 146 of the hydraulic operating circuit 54. The hydraulic cylinder 68 is illustrated in a retracted position in FIG. 3 and in partially extended position in FIG. 2. Of course, in operation, it will be appreciated that the hydraulic cylinder 68 may be urged to a full range of longitudinally adjusted positions to vary the combined length of the gangplank portion 18 to any desired length by adjusting the positions of the middle gangplank segment 26 and the fly segment 28 relative to the base segment 24.

The hydraulic cylinder 68 overfits the piston 66 and is in movable relationship therewith in response to the action of the hydraulic fluid 72 against the face of the piston 66. The remote end 74 of the cylinder 68 interconnects with the middle segment cylinder bracket 70 through a usual pin connection 76 as seen in FIGS. 2 and 3. In turn, the cylinder bracket 70 is securely affixed to a portion of the middle segment 26 in a strong, known manner, for example by welding to transfer extension and retraction forces from the cylinder 68 to the middle segment 26. Accordingly, as the cylinder 68 is urged outwardly relative to the stationary cylinder rod 58 upon action of the hydraulic fluid 72, its remote end connection 76 to the middle segment cylinder bracket 70 will cause the middle platform segment 76 to outwardly, longitudinally extend relative to the base segment 24. Upon release of hydraulic fluid pressure, reverse movement of the cylinder 68 will occur to thereby longitudinally retract the middle segment 26 relative to the base segment 24. In known manner, the hydraulic cylinder rod 58 is provided with extension and retraction hydraulic fluid ports 78, 80 which function in conjunction with the interior hydraulic oil tube 82 (FIG. 4) and the hydraulic power system 54 (FIG. 17) for hydraulic operation of the hydraulic cylinder means 56.

Upon application of hydraulic fluid under pressure at the inlet port 78 in response to either manual or automatic control as hereinafter more fully set forth, the hydraulic fluid 72 will flow through at the interior hydraulic oil tube 82 forwardly of the piston 66 to cause the hydraulic cylinder barrel 68 to extend or elongate relative to the fixed hydraulic cylinder rod 58. The extension of the hydraulic cylinder barrel 68 causes the middle gangplank segment 26 to also extend relative to the base gangplank segment 24 through the connection to the cylinder bracket 70 at the pin 76 (see FIG. 2). Similarly and conversely, after the middle segment 26 is urged to a desired extended position in relation to the base segment 24 in response to automatic or manual control as hereinafter more fully set forth, the hydraulic fluid 72 can be released through the outlet port 80 to cause the hydraulic cylinder barrel 68 to retract or telescope relative to the fixed hydraulic piston 66 and cylinder rod 58. The retraction of the hydraulic cylinder 68 serves to pull the middle gangplank segment 26 inwardly to thereby telescope the middle gangplank segment 26 into the base segment 24 (see FIG. 3).

Still referring to FIGS. 2 and 3, an extension cable 84 is illustrated interconnected between the gangplank segments 24, 26, 28. The cable 84 has one fixed end 86 securely tied to a side rail 30 of the gangplank base segment 24 in a suitable secure manner, such as a bolted interconnection 88. The second extension cable end 90 is secured to a portion of the fly segment 28 through a second bolted interconnection 92 in a secure, known manner to prevent disassociation. The medial portion of the extension cable 84 is trained about a pulley or crosshead 94, which pulley is rotatively secured near the forward end of the middle gangplank segment 26 construction in known manner. Accordingly, when the hydraulic cylinder 68 is outwardly urged from its innermost or retracted position as illustrated in FIG. 3 to an elongated or extended position as illustrated in FIG. 2, the middle gangplank segment 26 will be moved and similarly extended through the action of the interconnecting cylinder bracket 70 at the pin 76. The longitudinal extension of the middle segment 26 carries the pulley or crosshead 94 longitudinally outwardly away from the base segment 24, which, as previously described, is fixed into position about the bottom pivot 142 to prohibit longitudinal movement. As the middle segment 26 is urged outwardly upon function of the hydraulic system 54, the medial portion of the extension cable 84, which is trained about the crosshead 94, is caused to apply extension forces upon the fly segment 28 at the second bolted interconnection 92. It will thus be observed that as the middle segment 26 is extended relative to the base segment 24, the extension cable 84 will act to simultaneously pull the fly segment 28 outwardly relative to both the base segment 24 and the middle segment 26. The geometry of the system is such that upon function of the hydraulic cylinder 68, both the middle segment 26 and the fly segment 28 will move simultaneously to thereby extend the gangplank portion 18 to any desired position of elongation within the range of operation.

Still referring to FIGS. 2 and 3, it can be seen that a second, retraction cable 96 is also interconnected between the fly segment 28 and the base segment 24. The retraction cable 96 has a first end 98 secured to a side rail 44 of the fly segment 28 in a first fixed connection 100, which connection may be conventionally bolted in known manner. The second end 102 of the cable 96 securely affixes to the side rail 33 of the base segment 24 inwardly or downwardly of the first end 86 of the extension cable 84 and is secured in position by a second, fixed connection 104 which may also be bolted. Intermediate the first and second cable ends 98, 102, the retraction cable 96 is trained about a pulley or crosshead 106 which is rotatively secured near the rearward or inward end of the middle segment 26.

When it is desired to retract the fly segment 28 and the middle segment 26 relative to the base segment 24, the hydraulic circuit 54 functions to withdraw the hydraulic fluid 72 through the retraction port 80 to thereby retract or telescope the hydraulic cylinder body 68 relative to the fixed hydraulic cylinder rod 58 from an extended position as illustrated in FIG. 2 toward the retracted position indicated in FIG. 3. As the middle segment 26 is retracted or telescoped toward the base segment 24, the rotatively affixed pulley 106 will similarly be longitudinally downwardly urged. The inward or downward movement of the pulley 106 stresses the retraction cable 96 and applies retraction forces at the first retraction cable end 98 at the first fixed connection 100 to thereby also simultaneously pull the fly segment 28 inwardly in a telescoping movement relative to the middle segment 26 and base segment 24. When the parts reach the fully retracted position illustrated in FIG. 3, the extension gangplank portion 18 will be fully withdrawn to an initial position.

As shown in FIGS. 2, 3 and 4, a hollow cylindrical support tube 108 overfits and surrounds the hydraulic cylinder body 68 and generally defines an annular, cylindrical space 118 therewith. A plurality of exterior clamps 110, 112 114 securely affix the support tube 108 to the side rail construction 30 of the base segment 24 to prevent any relative movement of the support tube 108. The support tube 108 retains and confines the hydraulic cylinder body 68 and serves to maintain the general axial alignment of the cylinder 68 under all conditions of use. When the stresses inherent in the extension of the gangplank segments 26, 28 might tend to angularly cock or bend the cylinder 68 relative to the piston rod 58, the support tube 108 functions to prevent radial movement of the cylinder 68 through a distance greater than the thickness of the annular space 118. Should the forces inherent in the extension of the gangplank segments 26, 28 tend to flex or bend the cylinder 68 a greater distance from its normal, axially aligned, concentric position, the exterior periphery of the support hydraulic cylinder 68 will contact the interior periphery of the support tube 108 and thereby prevent or limit any further movement or angular displacement.

As shown in FIGS. 11–17, a basket or landing section 128 connects at the free end 122 of the fly segment 28 and is equipped with means 152, 152' to maintain the basket floor 148 generally level to provide a horizontal working platform for all extended or retracted positions and all elevated or depressed positions of the gangplank portion 18. A walkway 130 extends at right angles from a lateral end of the basket 128 and is pivotal thereabout at the connecting pins 126. The walkway 130 comprises generally a walkway section 131 and a ladder section 132 which is affixed to the walkway section in a rigid connection in known manner, such as by employing angle brackets 134 which are welded or otherwise secured to the walkway section. Accordingly, the walkway section 131 and the affixed ladder section 132 are freely pivotal relative to the basket section 128 about the pins 126 in response to changes in elevation of the deck 22 of the ship 14.

As illustrated in FIGS. 11–16, a pair of control limit micro switches comprising an elevation controller limit switch 136 and an elongation controller limit switch 138 are secured in operable position below the platform of the landing section 128. Each switch 136, 138 has its active element in contact with a portion of the walkway section 130 to thereby monitor the pivoted elevational angular position or the lateral angular position of the walkway section 130 relative to the basket section 128.

Figure 5:
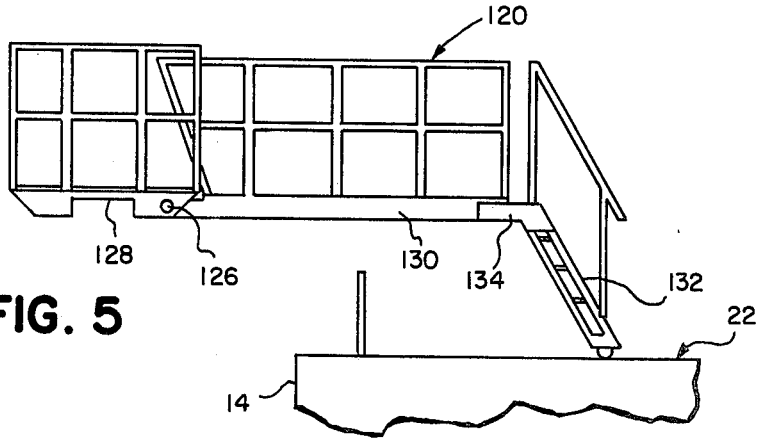
FIG. 5 is an end elevational view of the walkway resting upon the deck of a ship in generally horizontal relationship.
Figure 6:
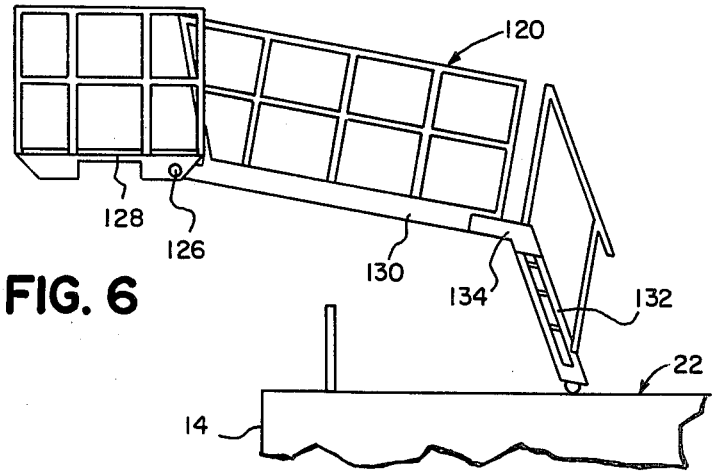
FIG. 6 shows the position of the walkway of FIG. 5 after the ship has been partially unloaded.
Figure 7:
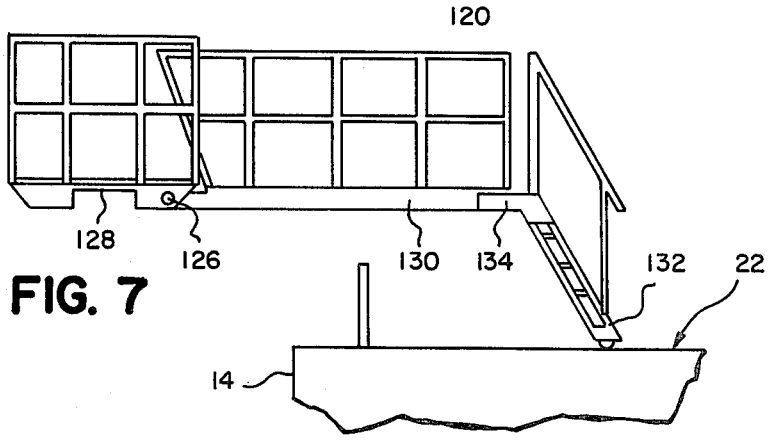
FIG. 7 shows the walkway of FIG. 6 returned to a generally horizontal position upon function of the automatic height controller.

Referring now to FIGS. 5–7, the function of the elevation controller limit switch 136 will now be described. FIG. 5 illustrates the relative position of the walkway 130 when the bottom of the ladder section 132 rests upon the deck 22 of a ship 14 in an initial, generally horizontal position. Upon initiation of loading the ship with its cargo, the ship will begin to rest lower in the water and thereby cause the deck 22 to be lowered toward the fixed elevation of the pier 12. Under such a condition, the walkway 130 will tend to pivot about the basket connected pin 126 and thus angularly depend from the general, horizontal alignment (see FIG. 6). When the angularity of the walkway 130 reaches a predetermined maximum condition, for example, ten degrees below the horizontal, the elevation controller switch 136 will be automatically activated to function the hydraulic system 54 to lower the cylinders 140, 140' to thus pivot the extending gangplank portion 18 about its bottom pivot 142. This in turn will lower the free end 122 of the fly segment 28, thus causing a corresponding decrease in elevation of the affixed basket or landing section 128. When the elevation of the basket 128 is decreased, this causes the pivotally affixed walkway 130 to pivot about the pins 126 and again assume the generally horizontal or level position relative to the deck 22 of the ship 14 (see FIG. 7). Accordingly, as the ship 14 is continuously loaded from an empty condition to a completely filled condition, the elevation controller limit switch 136 will function in incremental steps to continuously lower the lift cylinders 140, 140' and correspondingly lower the basket 128 to maintain automatically generally horizontal alignment of the walkway 130.

Figure 8:
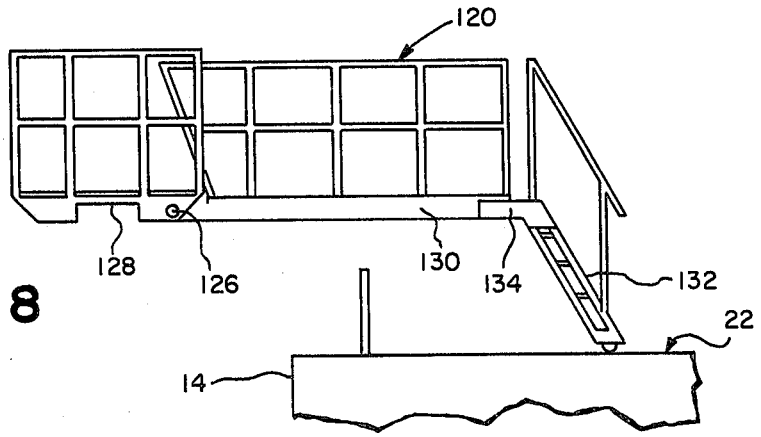
FIG. 8 is an end elevational view similar to FIG. 5 showing the walkway in generally horizontal relationship.
Figure 9:
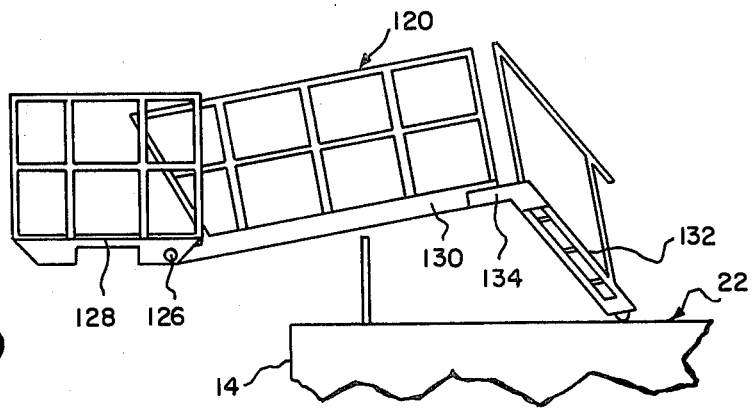
FIG. 9 shows the position of the walkway of FIG. 8 after the ship has been partially loaded.
Figure 10:
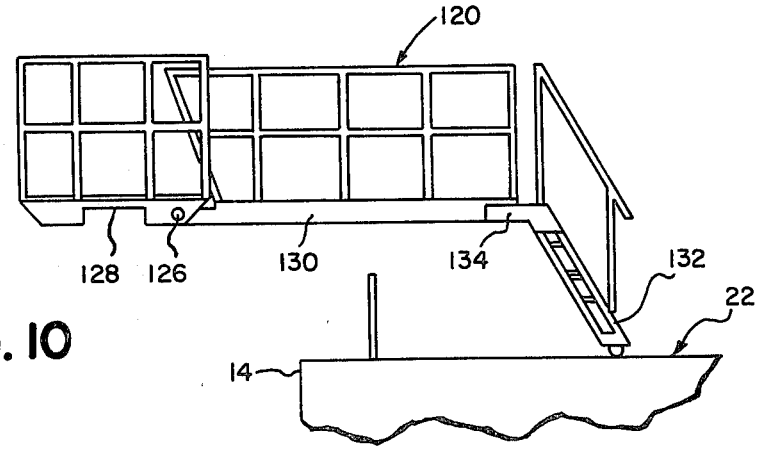
FIG. 10 shows the walkway of FIG. 9 returned to the generally horizontal position upon function of the automatic height controller.

Similarly, as can be seen in FIGS. 8–10, when the ship 14 is in a fully loaded condition, and unloading procedures are initiated, the ship will become increasingly lighter in the water and thus raise the level of the deck 22 of the ship relative to the fixed elevation of the pier 12. As the cargo, for example oil, is unloaded, the rise in elevation of the deck 22 will cause the walkway 130 to pivot upwardly about the pins 126 relative to the basket 128 as indicated in FIG. 9. When a predetermined pivotal position is reached, for example ten degrees above the horizontal, the elevation controller limit switch 136 will again be activated to function the lift cylinders 140, 140' to raise the extending gangplank portion 18 pivotally about the bottom pivot 142 and thereby increase the elevation of the end 122 of the fly segment 28 and the affixed basket 128. When the lift cylinders 140, 140' elevate the landing section 128 sufficiently to achieve the desired generally level orientation of the walkway 130, the elevation controller limit switch 136 will be deactivated to thereby similarly deactivate the lift cylinders 140, 140'. It is thus seen that the hydraulic system 54 functions automatically and incrementally from the fully loaded condition of the ship to the fully empty condition of the ship to continuously and automatically adjust the height of the landing section 128 to maintain generally horizontal alignment of the walkway 130 relative to the deck 22 of the ship 14.

Figure 17:
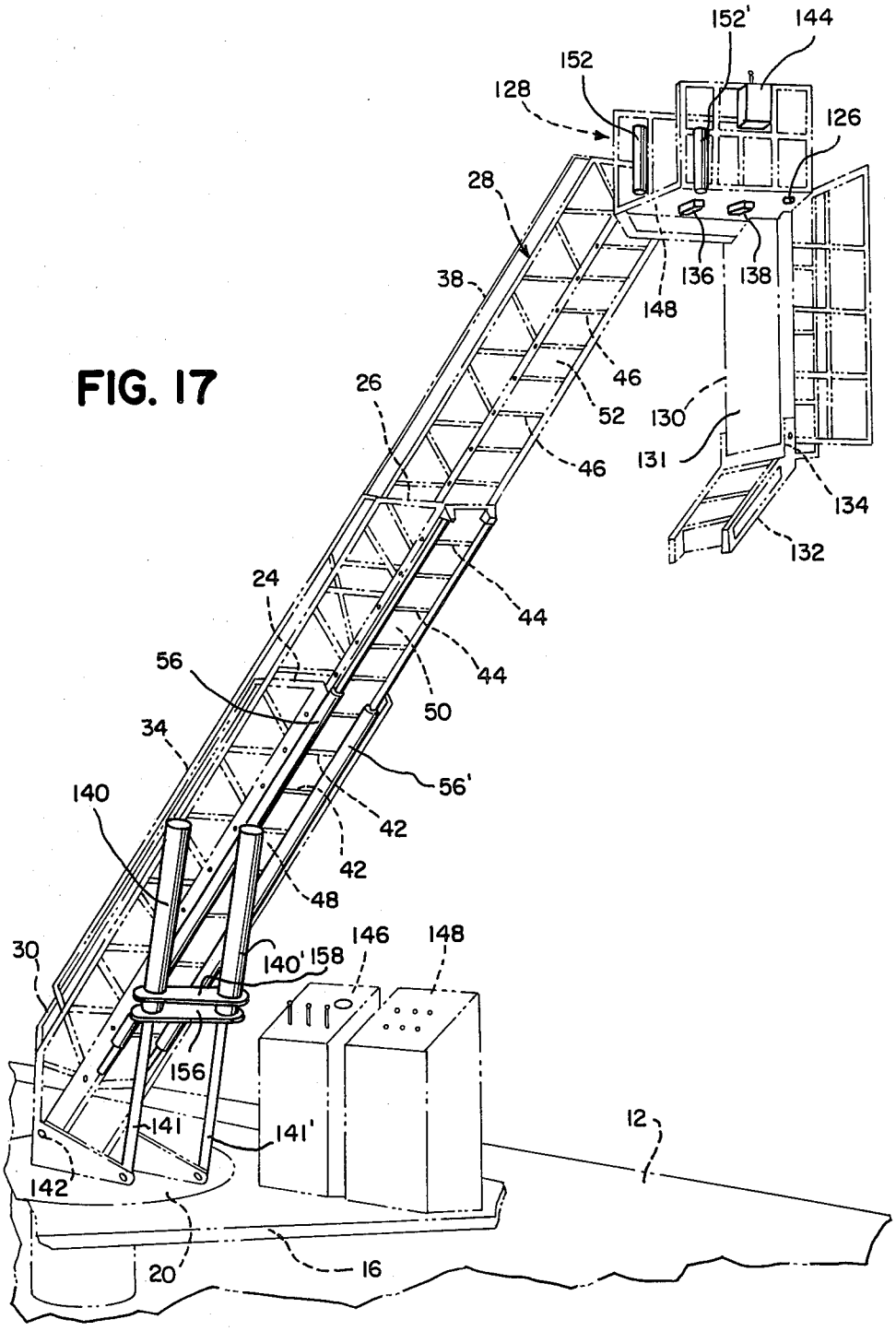
FIG. 17 is a bottom perspective view of some of the hydraulic system components with portions of the automatic safety gangplank illustrated in phantom lines for purposes of association.

It is noteworthy that the lifting links 156, 158 interconnect and tie together the lift cylinders 140, 140' into a single structural module. By installing the lift cylinders in an upside down position as illustrated in FIG. 17, the links 156, 158 and the lift cylinders 140, 140' become a total structural member which takes all of the load and becomes the lifting point underneath the ladder. It is possible to reverse the orientation of the lift cylinders 140, 140' to thereby have the respective cylinder rods 141, 141' push directly against the ladder or boom. However, in such an arrangement, a larger cylinder would be required.

Figures 11, 12, 13, 14, 15, 16:
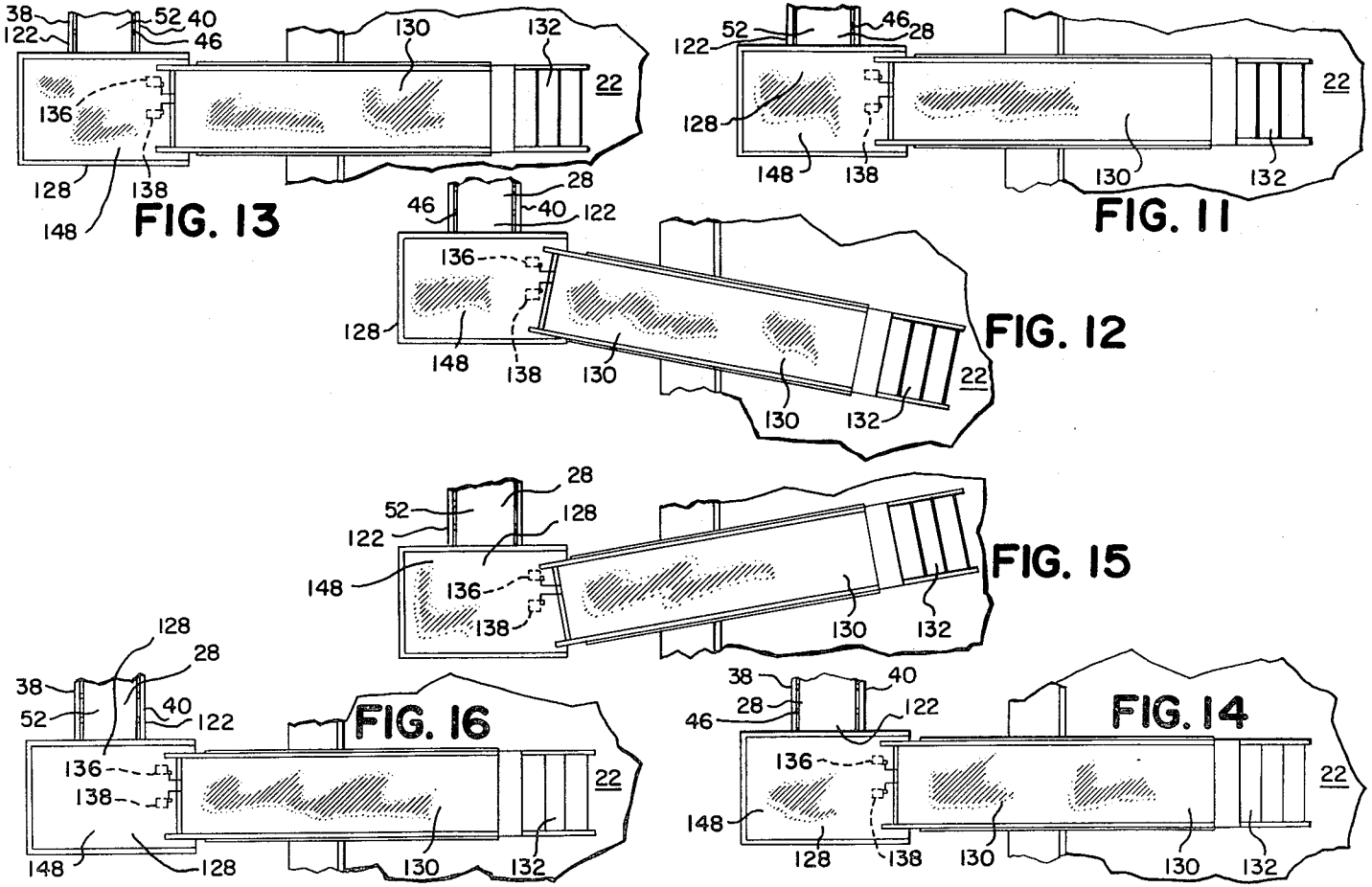
FIG. 11 is a top plan view of the walkway resting upon the deck of a ship in generally right angle relationship to the longitudinal axis of the gangplank.
FIG. 12 shows the position of the walkway of FIG. 11 with the gangplank segments relatively foreshortened in relationship to the deck of the ship.
FIG. 13 shows the walkway of FIG. 12 returned to the generally right angle relationship upon function of the automatic elongation controller.
FIG. 14 is a view similar to FIG. 11 showing the walkway in generally right angle relationship to the longitudinal axis of the gangplank.
FIG. 15 shows the position of the walkway of FIG. 14 with the gangplank segments relatively elongated in relationship to the deck of the ship.
FIG. 16 shows the walkway of FIG. 15 returned to the generally right angle relationship upon function of the automatic gangplank elongation controller.

Referring now to FIGS. 11–13, it will be noted that as the deck 22 of the ship 14 is caused to rise relative to the fixed elevation of the pier 12, there will be a foreshortening effect in the gangplank portion whether or not the lift cylinders 140, 140' are functioned to elevate the gangplank portion 18. This foreshortening effect occurs as a result of the greater overall distance between the stationary platform 16 and the ship deck 22 that must be spanned as the deck rises. Because of this, there will be a change in angularity created between the walkway 130 and the perpendicular to the longitudinal axis of the gangplank. In order to compensate for the angularity of the walkway 130 as illustrated in FIG. 12, the elevation controller limit switch 138 is connected to sense a predetermined angularity, for example ten degrees from the perpendicular to the longitudinal axis of the gangplank. Accordingly, when the deck 22 is elevated sufficiently to cause an angle of ten degrees or more between the axis of the walkway 130 and the perpendicular to the longitudinal axis of the gangplank, the elevation controller limit switch 138 activates to function the hydraulic cylinder means 56, 56' to extend the gangplank portion 18 in the manner hereinbefore described. When the gangplank portion extends sufficiently to urge the walkway 130 to the desired perpendicular position as illustrated in FIG. 13, the elevation controller limit switch 138 will deactivate to cease function of the hydraulic cylinder means 56, 56'. As the ship is continuously unloaded and the deck 22 continues to rise, the elongation controller switch 138 will function automatically and intermittently to maintain the length of the gangplank portion 18 sufficient to assure that the walkway 130 remains substantially at right angles to the longitudinal axis of the gangplank portion 18.

Similarly and conversely, when considering the illustrations in FIGS. 14–16, when the ship 14 is initially unloaded and is in a cargo loading condition at the pier 12, then the level of the deck 22 will fall relative to the fixed level of the pier 12 as the ship is loaded. The falling of the deck elevation during loading will cause the walkway 130 to angularly cock in the opposite direction as illustrated in FIG. 15 inasmuch as the gangplank portion will tend toward elongation. Upon reaching a predetermined angularity with the perpendicular to the longitudinal axis of the gangplank, for example ten degrees, the elongation controller limit switch 138 will function to activate the hydraulic cylinder means 56, 56' to retract the gangplank portion 18 sufficiently to again align the walkway section 130 substantially perpendicular to the longitudinal axis (see FIG. 16).

It will be appreciated that the elevation limit controller switch 136 and the gangplank elongation controller 138 act independently and automatically in response to different conditions, that is in the first instance the level of the walkway 130 and in the second instance the angularity of the walkway 130. Both switches function independently to maintain the predetermined parameters of vertical and horizontal angularity to thereby assure a completely safe passageway from the platform 26 to the deck 22 at all times when the ship is either being loaded, unloaded or is in stationary relationship to the pier. In known manner, the hydraulic cylinders 152, 152' interconnect between the basket 128 and the fly segment end 122 to maintain the basket floor 148 substantially level at all times.

In order to use the automatic safety gangplank 10 of the present invention, it is preferable to provide manual controls 144, 146 both at the platform 16 and at the elevating basket or landing section 128 whereby the apparatus can be functioned either from a position adjacent to the pier 12 or from an elevated position near the deck 22 of the ship or tanker 14. The hydraulic system can be manually functioned as necessary to both elevate the gangplank portion 18 by energizing the hydraulic lift cylinders 140, 140' and to extend the gangplank portion 18 by energizing the hydraulic cylinder means 56, 56' to thereby position the basket 128 adjacent to and slightly above the deck 22 of the ship. See FIGS. 1 and 17.

The walkway 130 is pivotally secured to the basket section 128 by the pins 126 and accordingly, when the walkway 130 is initially being raised toward the deck of the ship upon elevation of the gangplank portion 18, the walkway will simply hang vertically from the pins 126 as shown in FIG. 17. In use, a suitable line or hoist (not shown) supported from the ship 14 can be manually secured to the hanging extremity of the walkway section 130 or to the attached ladder section 132 and the walkway 130 can then be manually or mechanically pulled upwardly about the pivot pins 126 to position the ladder section 132 upon the surface of the deck 22. Once the ladder section 132 is firmly positioned on the deck 22, the manual controls 144, 146, either at the platform level 16 or at the basket section 128 are functioned as necessary to either elevate or lower the lift cylinders 140, 140' and to either extend or retract the hydraulic cylinder means 56, 56' as may be required in final adjustments to position the walkway 130 generally perpendicular to the longitudinal axis of the gangplank as illustrated in FIGS. 11 and 13 and in general horizontal orientation as illustrated in FIGS. 5 and 7. Preferably, after the walkway 130 is positioned in the desired location and orientation, the manual controller 144 located in the basket 128 and the manual controller 146 at the platform are deactivated to thereby prevent unintentional or unauthorized operation of the device while the ship is in port. The automatic limit micro switches 136, 138 will then be activated so that the desired position and angularity of the automatic safety gangplank 10 will be automatically maintained in response to changes in deck elevation relative to the pier 12.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In an extendable walkway of the type suitable to extend from a construction of fixed elevation to the deck of a ship, wherein the deck is movable between a lower elevation and higher elevation, the combination of extendable gangplank means to span the distance from the elevation of the construction to elevation of the deck, the extendable gangplank means comprising at least a base segment and a fly segment, the fly segment being adapted to move in longitudinal telescoping relationship to the base segment, the base segment having a connected end and an elevating end; and the fly segment terminating outwardly from the base segment in a free end;

extending means interconnected between the base segment and the fly segment to longitudinally move the fly segment relative to the base segment;

elevating means interconnected between the construction and the gangplank means to elevate a portion of the gangplank means about the connected end of the base segment;

walkway means pivotally connected to the gangplank means, the walkway means being adapted to contact the deck, the walkway means extending between the deck and a portion of the gangplank means, the walkway means being adapted to angularly move relative to the gangplank means when the elevation of the deck is varied; and first gangplank movement control means comprising an active element in contact with a portion of the walkway means, the first gangplank movement control means being adapted to monitor a change in angularity of the walkway means about a horizontal axis in response to a change in deck elevation, the elevating means being adapted to be activated in response to change in deck elevation monitored by the first gangplank movement control means to elevate or lower a portion of the gangplank means.

2. The extendable walkway of claim 1 wherein the first gangplank movement control means comprises means to automatically monitor the said change in angularity.

3. The extendable walkway of claim 1 and a landing section pivotally connected to the free end of the fly segment.

4. The extendable walkway of claim 3 wherein the first gangplank movement control means is mounted upon the landing section.

5. The extendable walkway of claim 4 and a second gangplank movement control means mounted upon the landing section, the second gangplank movement control means comprising an active element in contact with a portion of the walkway means, the second gangplank movement control means being adapted to monitor a change in angularity of the walkway means about a vertical axis in response to a change in deck elevation.

6. The extendable walkway of claim 3 wherein the walkway means pivotally connects to the landing section.

7. The extendable walkway of claim 3 and second gangplank movement control means comprising an active element in contact with a portion of the walkway means, the second gangplank movement control means being adapted to monitor a change in angularity of the walkway about a vertical axis in response to a change in deck elevation.

8. The extendable walkway of claim 7 wherein the extending means is adapted to be activated by the second gangplank movement control means in response to change in angularity of the walkway about a vertical axis.

9. The extendable walkway of claim 7 wherein the second gangplank movement control means mounts upon the landing section and is adapted to automatically monitor the said change in angularity.

10. The extendable walkway of claim 7 wherein the walkway means and the gangplank means each comprise a respective longitudinal axis and wherein the longitudinal axis of the walkway means is positioned at substantially right angles to the longitudinal axis of the gangplank means.

11. The extendable walkway of claim 10 wherein the longitudinal axis of the walkway means is adapted to angularly move about the vertical axis from the right angle position through a distance of at least about ten degrees.

12. The extendable walkway of claim 11 wherein the walkway means activates the second gangplank movement control means when it is angularly moved from the said right angle position to restore the said angular relationship between the walkway means and the gangplank means.

13. The extendable walkway of claim 12 wherein the walkway means is adapted to activate the second gangplank movement control means when the angular movement of the walkway means from the right angle position reaches about ten degrees.

14. The extendable walkway of claim 7 wherein at least a portion of the walkway means is adapted to extend in substantially horizontal position from the gangplank means.

15. The extendable walkway of claim 14 wherein the said position of the walkway means is adapted to angularly move about a horizontal axis through a distance of at least about ten degrees.

16. The extendable walkway of claim 15 wherein the walkway means activates the first gangplank movement control means when it is angularly moved from the said horizontal position to restore the walkway means to its horizontal position.

17. The extendable walkway of claim 16 wherein the walkway means is adapted to activate the first gangplank movement control means when the angular movement of the walkway means from the horizontal reaches about ten degrees.

18. The extendable walkway of claim 7 wherein the second gangplank movement control means comprises a second micro switch.

19. The extendable walkway of claim 1 and a third gangplank movement control means stationarily mounted relative to the construction and adapted to manually function the said extending means.

20. The extendable walkway of claim 1 and a fourth gangplank movement control means stationarily mounted relative to the construction and adapted to manually activate the said elevating means to either elevate or lower the said gangplank means.

21. The extendable walkway of claim 1 wherein the said extending means comprises a hydraulic cylinder.

22. The extendable walkway of claim 1 wherein the said elevating means comprises a hydraulic cylinder.

23. The extendable walkway of claim 1 wherein the first gangplank movement control means comprises a first micro switch and wherein the said active element is a part of the first micro switch.

24. The extendable walkway of claim 1 wherein the elevating means comprises a first hydraulic cylinder having a cylinder and a rod.

25. The extendable walkway of claim 24 wherein the elevating means comprises a second hydraulic cylinder in parallel arrangement to the first cylinder, the second cylinder having a cylinder and a rod.

26. The extendable walkway of claim 25 and a lifting link interconnecting the first and second hydraulic cylinders to tie them together into a single lifting module.

27. The extendable walkway of claim 26 wherein the lifting link interconnects the respective cylinders of the first and second hydraulic cylinders.

28. The extendable walkway of claim 24 wherein the rod interconnects with the said base segment.

29. In an automatic safety gangplank for extending from a construction of fixed elevation to a surface of movable elevation, the combination of a multi-segment gangplank comprising at least a base segment and a fly segment in telescoping arrangement therewith and extending between the fixed construction and the movable surface, the base segment having one end pivotally affixed to the fixed construction by a turntable, the turntable having a vertical axis and a horizontal axis, the base segment being adapted to rotate about the vertical axis upon movement of the turntable and to rotate about the horizontal axis;

means to elevate and lower the gangplank when the elevation of the movable surface changes by rotating the base segment about the horizontal axis;

means to extend and retract the fly segment relative to the base segment to change the overall length of the gangplank;

walkway means extending angularly from the fly segment and contacting the said movable surface, the walkway means being adapted to rotate in a substantially vertical plane about its connection to the fly segment and being adapted to rotate in a substantially horizontal plane about its connection to the fly segment;

first automatic means to adjust the length of the gangplank in response to a predetermined amount of rotation in a horizontal plane of the walkway means to maintain contact between the walkway means and the movable surface; and second automatic means to adjust the elevation of the gangplank means in response to a predetermined amount of rotation in a vertical plane of the walkway means to maintain contact between the walkway means and the movable surface;

whereby an automatically extendable and elevatable safety gangplank responsive to changes in elevation of the movable surface is provided.

30. The automatic safety gangplank of claim 29 wherein the first automatic means comprises a first micro switch.

31. The automatic safety gangplank of claim 29 or 30 wherein the second automatic means comprises a second micro switch.

32. In an automatic safety gangplank capable of extending between a fixed pier and the deck of a ship, the combination of telescoping gangplank segment means extending from the fixed pier, the gangplank segment means including rotating means, elevating means and extending means to rotate, elevate and extend the gangplank segment means from the fixed pier to the vicinity of the deck;

walkway means to span between the deck and the remote end of the gangplank segment means;

manual control means to manually activate the elevating means and the extending means to adjust the length and height of the gangplank segment means to position the walkway means in substantial horizontal orientation in angular relationship to the longitudinal axis of the gangplank segment means; and automatic control means responsive to changes in the angularity of the walkway means relative to the gangplank segment means caused by the rise or fall of the level of the deck above the pier to automatically activate the elevating means and the extending means to adjust the height and length of the telescoping gangplank segment means;

whereby predetermined conditions of walkway means angularity can be automatically maintained.

33. The automatic safety gangplank of claim 32 wherein the automatic control means comprises a micro switch.

34. The automatic safety gangplank of claim 33 wherein the micro switch is adapted to monitor the change level of the walkway means.

35. The automatic safety gangplank of claim 33 or 34 and a second micro switch, the second micro switch being adapted to monitor a change in angularity between the longitudinal axis of the walkway means and the longitudinal axis of the gangplank segment means.

36. The automatic safety gangplank of claim 32 and means to deactivate the manual control means when the automatic control means is activated.

* * * * *